US005619187A

United States Patent [19]

Serfontein

[11] Patent Number: 5,619,187

[45] Date of Patent: Apr. 8, 1997

[54] ALARM TO PREVENT DROWNING

[76] Inventor: Marius P. Serfontein, P.O. Box 21233, Richards Bay 3900, South Africa

[21] Appl. No.: 533,284

[22] Filed: Sep. 25, 1995

[51] Int. Cl.[6] ..... G08B 23/00

[52] U.S. Cl. ..... 340/573; 340/604; 200/61.04

[58] Field of Search ..... 340/573, 604, 340/620, 539; 200/61.04

[56] References Cited

U.S. PATENT DOCUMENTS 3,810,146 5/1974 Lieb ..... 340/573
4,305,143 12/1981 Simms et al. ..... 340/573
4,714,914 12/1987 Boe ..... 340/573

*Primary Examiner*—Jeffery Hofsass
*Assistant Examiner*—Benjamin C. Lee
*Attorney, Agent, or Firm*—Young & Thompson

[57] ABSTRACT

A warning device for the prevention of drowning includes a sensor 10 incorporating a transmitter, the sensor being attachable to the body of a person. The transmitter is actuated upon submersion in water. The signal emitted by the transmitter is received by receiver 12 which is then adapted to initiate an alarm in the form of a siren, flashing light or lights or a transmission to other alarm systems. A directional antenna may be included for nautical situations where the wearer is thrown overboard.

3 Claims, 2 Drawing Sheets

ALARM TO PREVENT DROWNING

FIELD OF THE INVENTION

This invention relates to an alarm device for preventing drowning in swimming pools and also, in its wider application, for preventing other tragedy situations.

BACKGROUND OF THE INVENTION

The conventional means for preventing drownings in private pools include the provision of fences with self-closing gates, pool covers and one or more alarm systems which rely on disturbance of the water level or some other circumstance.

Gates are left open, or no longer operate automatically, pool nets are forgotten and surface-sensitive devices and others are often initiated by cats, dogs and other harmless agencies.

It has therefore become important to provide a device which is reliable and gives parents and bystanders timely warning of a possible drowning or other accident in a pool, or in a yachting or other boating or shipping activity.

SUMMARY OF THE INVENTION

According to the invention a warning device includes a transmitter adapted to be attached to the body of a subject and having a frequency receivable by a receiver located strategically, and actuatable when submerged in water.

Thus, the transmitter may be included in a wrist strap, broach, pendant or the like.

In a preferred form of the invention the transmitter is only actuatable when fully submerged in water. This avoids the actuation thereof by casual water splashing, for example.

In order to achieve this the electrical contacts of the transmitter are separated by a plate or the like and/or may be separated by a substantial distance—for example being at an angle to one another in the strap, broach or the like.

The receiver may be mounted near the pool, on a boat, yacht or maritime vessel or near the body of water. In the case of maritime use the receiver may include direction sensitive equipment so that the subject can be pinpointed.

BRIEF DESCRIPTION OF THE DRAWINGS

An embodiment of the invention is described below with reference to the accompanying drawings, in which.

DETAILED DESCRIPTION OF THE INVENTION

Figure 1:
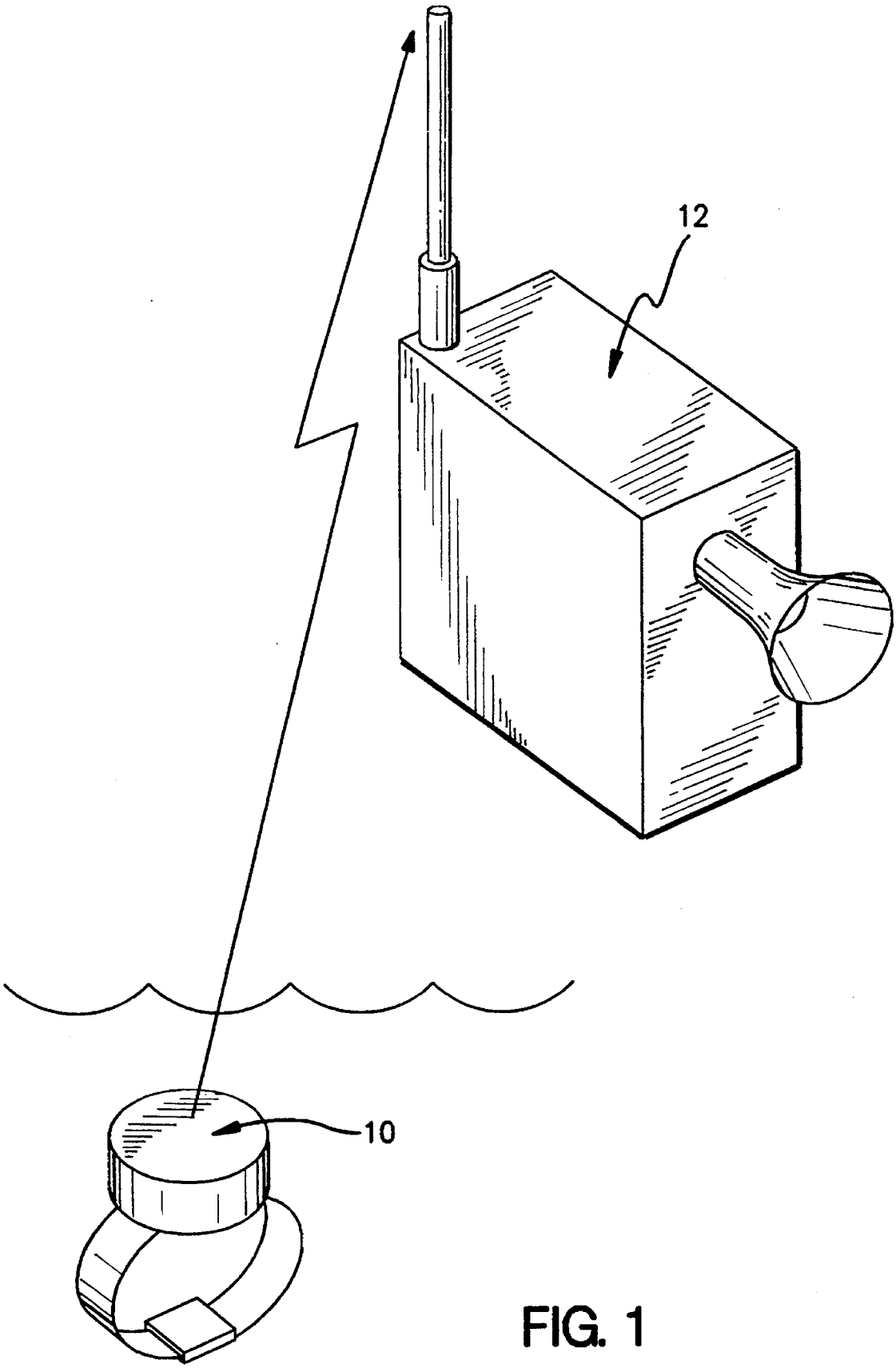
FIG. 1 is a schematic representation of the principle of the invention.

In FIG. 1 a sensor 10 is shown which is attached to the body of a person or other subject and which includes a transmitter actuated when the sensor is completely submerged in water. The signal emitted by the sensor is received by a receiver 12 which initiates an alarm, which may be a siren call, flashing lamp, transmission to other alarm systems, or other alarm means. For nautical purposes, a directional antenna may be included to assist in the location of the subject.

Figure 2:
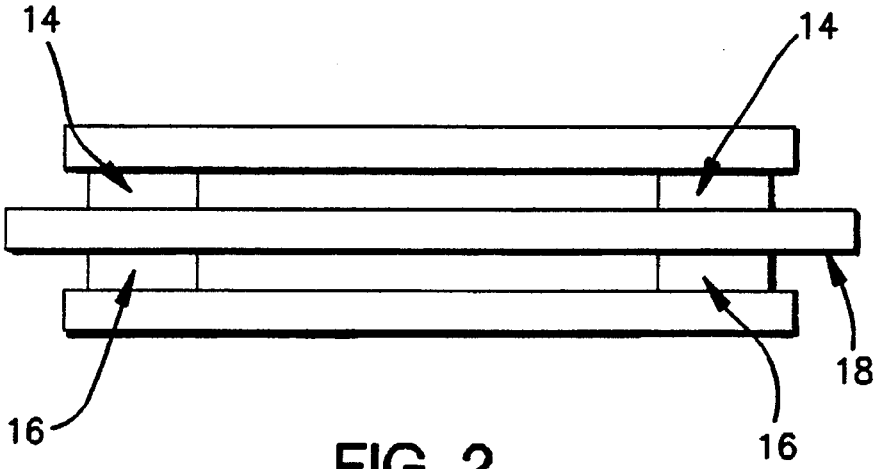
FIG. 2 is a side view of one form of sensor for use in the invention.
Figure 3:
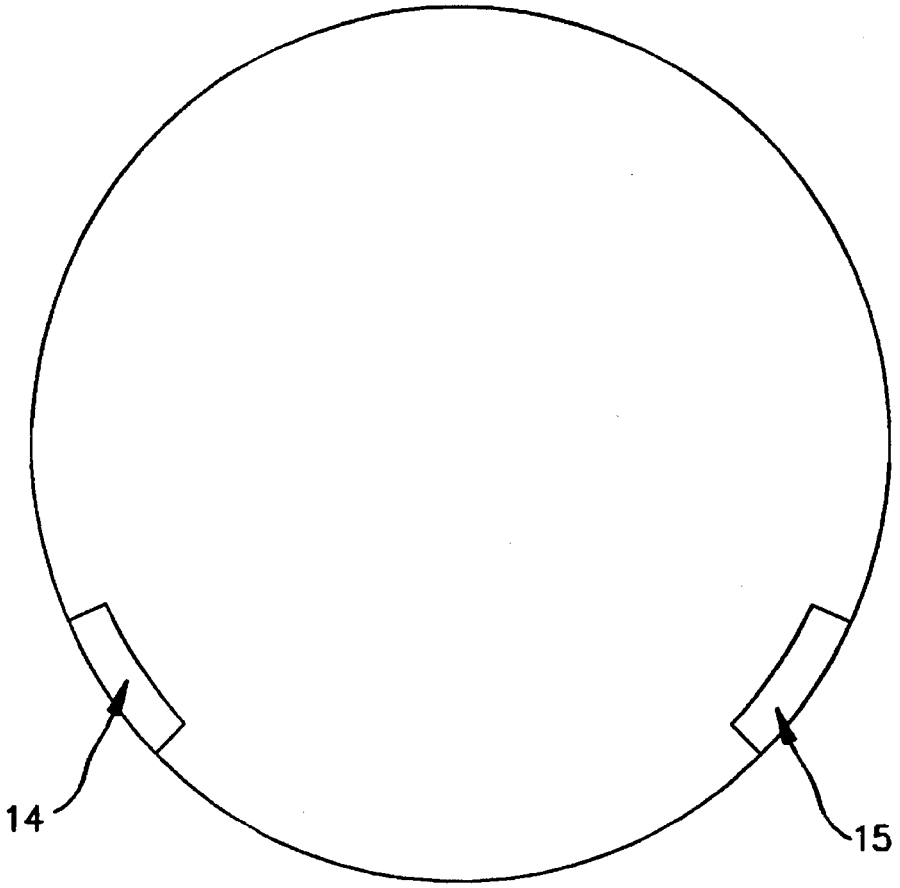
FIG. 3 is a plan view thereof.

Referring to FIGS. 2 and 3, the sensor is arranged so that false alarms are not given due to harmless splashing or causal moisture build up. Contacts 14, 16 are provided which are separated by plates 18. In addition, the contacts 14,16 are separated by an angle of about 45°.

Thus, in normal use, droplets will drip from the edges of the plates 18 but when completely submerged, the contacts will be activated.

I claim:

1. A warning device comprising a transmitter adapted to be attached to the body of a subject, and having a frequency receivable by a receiver strategically locatable, said transmitter including two or more contacts separated by a plate located between the contacts, said plate projecting outwardly of said contacts, thereby to prevent actuation thereof by splashing, wherein actuation activates a warning at said receiver, and said contacts being positioned peripherally at a predetermined angular orientation along the perimeter of the transmitter.

2. The warning device according to claim 1, wherein the transmitter is included in a wrist strap, broach, or pendant.

3. The warning device according to claim 1, wherein the transmitter is only actuatable when fully submerged in water.

* * * * *